US010964262B1

(12) United States Patent
Lin et al.

(10) Patent No.: US 10,964,262 B1
(45) Date of Patent: Mar. 30, 2021

(54) SYSTEMS AND METHODS FOR REDUCING VISUAL ARTIFACTS IN DISPLAYS DUE TO REFRESH RATE

(71) Applicant: Apple Inc., Cupertino, CA (US)

(72) Inventors: Chin-Wei Lin, San Jose, CA (US); Shinya Ono, Cupertino, CA (US); Yun Wang, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/414,512

(22) Filed: May 16, 2019

Related U.S. Application Data

(60) Provisional application No. 62/725,146, filed on Aug. 30, 2018.

(51) Int. Cl.

| | |
|---|---|
| ***G09G 5/10*** | (2006.01) |
| ***G09G 3/3233*** | (2016.01) |
| ***G09G 3/20*** | (2006.01) |

(52) U.S. Cl.
CPC ..... *G09G 3/3233* (2013.01); *G09G 3/2022* (2013.01); *G09G 2320/0247* (2013.01); *G09G 2320/064* (2013.01); *G09G 2320/0646* (2013.01)

(58) Field of Classification Search
USPC ..... 345/76, 204, 211, 690, 691, 694, 77; 348/175.687
See application file for complete search history.

(56) References Cited

U.S. PATENT DOCUMENTS

| | | | | |
|---|---|---|---|---|
| 7,425,996 | B2 | 9/2008 | Ando | |
| 7,940,236 | B2 | 5/2011 | Miller et al. | |
| 9,715,856 | B2 | 7/2017 | Wang et al. | |
| 2003/0117361 | A1* | 6/2003 | Sono | G09G 3/002 345/94 |
| 2005/0231498 | A1* | 10/2005 | Abe | G09G 3/20 345/204 |
| 2006/0007249 | A1* | 1/2006 | Reddy | G06F 3/0412 345/690 |
| 2009/0219231 | A1* | 9/2009 | Yamamoto | G09G 3/3233 345/76 |
| 2010/0103205 | A1* | 4/2010 | Iisaka | G09G 3/3413 345/690 |
| 2011/0211127 | A1* | 9/2011 | Kelvin | H04N 9/68 348/687 |

(Continued)

*Primary Examiner* — Thuy N Pardo
(74) *Attorney, Agent, or Firm* — Fletcher Yoder, P.C.

(57) ABSTRACT

Techniques for reducing image artifacts on a display s may include receiving image data, such that the image data includes pixel luminance data for a frame of image data. The technique may also include determining an emission duration for a pixel of the plurality of pixels during a sub-frame of the frame of image data based on the pixel luminance data. The technique may also include determining an emission duration extension to apply to the emission duration associated with the sub-frame based on a luminance baseline associated with the sub-frame, a luminance level associated with the sub-frame, and a time period associated with the sub-frame. The technique may then involve sending an emission signal to the pixel, such that the emission signal is configured to cause the pixel to emit light for a duration that correspond to the emission duration and the emission duration extension.

18 Claims, 9 Drawing Sheets

(56) References Cited

U.S. PATENT DOCUMENTS

| | | | | |
|---|---|---|---|---|
| 2013/0106823 | A1* | 5/2013 | Kishi | G09G 3/3258 345/211 |
| 2013/0127924 | A1* | 5/2013 | Lee | G09G 3/32 345/690 |
| 2013/0321483 | A1* | 12/2013 | You | G09G 3/3651 345/690 |
| 2015/0187277 | A1* | 7/2015 | Maeyama | G09G 3/3688 345/694 |
| 2016/0247435 | A1* | 8/2016 | Park | G09G 3/3648 345/691 |
| 2016/0275845 | A1 | 9/2016 | Tsai et al. | |
| 2017/0004753 | A1 | 1/2017 | Kim et al. | |
| 2017/0061880 | A1* | 3/2017 | Choi | G09G 3/3233 345/691 |
| 2017/0330502 | A1* | 11/2017 | Jang | G09G 3/3233 345/77 |
| 2018/0027222 | A1* | 1/2018 | Ogasawara | G06K 9/4652 348/175 |
| 2018/0075801 | A1 | 3/2018 | Le et al. | |
| 2020/0265773 | A1* | 8/2020 | Fujii | G09G 3/2092 345/84 |

* cited by examiner

SYSTEMS AND METHODS FOR REDUCING VISUAL ARTIFACTS IN DISPLAYS DUE TO REFRESH RATE

CROSS-REFERENCE TO RELATED APPLICATION

This application claims priority to and the benefit of U.S. Provisional Application No. 62/725,146, entitled "SYSTEMS AND METHODS FOR REDUCING VISUAL ARTIFACTS IN DISPLAYS DUE TO REFRESH RATE," filed Aug. 30, 2018, which is herein incorporated by reference in its entirety.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure relates to devices and methods for increasing power conservation for LED displays, such as OLED or active-matrix organic light emitting diode (AMOLED) displays, while reducing potential visual artifacts that may accompany the increases in power conservation by using images displayed at lower refresh rates. For LED displays, emissive power is content dependent and not governed by backlight power, as is traditionally used for a liquid crystal display (LCD).

Accordingly, one technique to reduce power consumption of an AMOLED or OLED device may include extending the light emission duration of sub-frames of a frame with a low refresh rate (e.g., the rate at which an array of display pixels in the display is written with image data). Low refresh rates (e.g., less than 60 Hz) driving the display may reduce the amount of power expended to drive the display, and thus, may enhance the battery life of a device. However, utilizing reduced refresh rates for displaying an image may be accompanied by visual artifacts generated on the display. For example, one visual artifact that may be generated is a flicker effect (e.g., fluctuating light), which may be perceived by a user due to the same brightness or luminance value being presented on a display in consecutive frames of image data at a low refresh rate.

In one embodiment, to reduce the appearance of the visual artifact (e.g., flicker effect) an additional emission signal may be provided to pixel circuitry to pulse an emission current to the pixel circuitry, thereby extending an amount of time that a corresponding pixel is emitting. By extending the emission period for a pixel during a frame of image data, the average luminance of the frame of sub-frames may increase and reduce the display flickering effects that may otherwise be detected by a human eye viewing the image data presented on the display. That is, pixel driving circuitry may transmit additional emission currents during a sub-frame of a frame of image data to increase the overall average luminance that the human eye perceives. By increasing the average luminance detected by a human eye during a frame of image data, the user may be less likely to perceive flicker effects occurring in the display. Accordingly, the present disclosure includes devices and techniques that utilize pulse width modulation emission signals to increase the emission period during frames of image data that are depicted using low refresh rates to reduce visual artifacts generated on a display.

Various refinements of the features noted above may be made in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
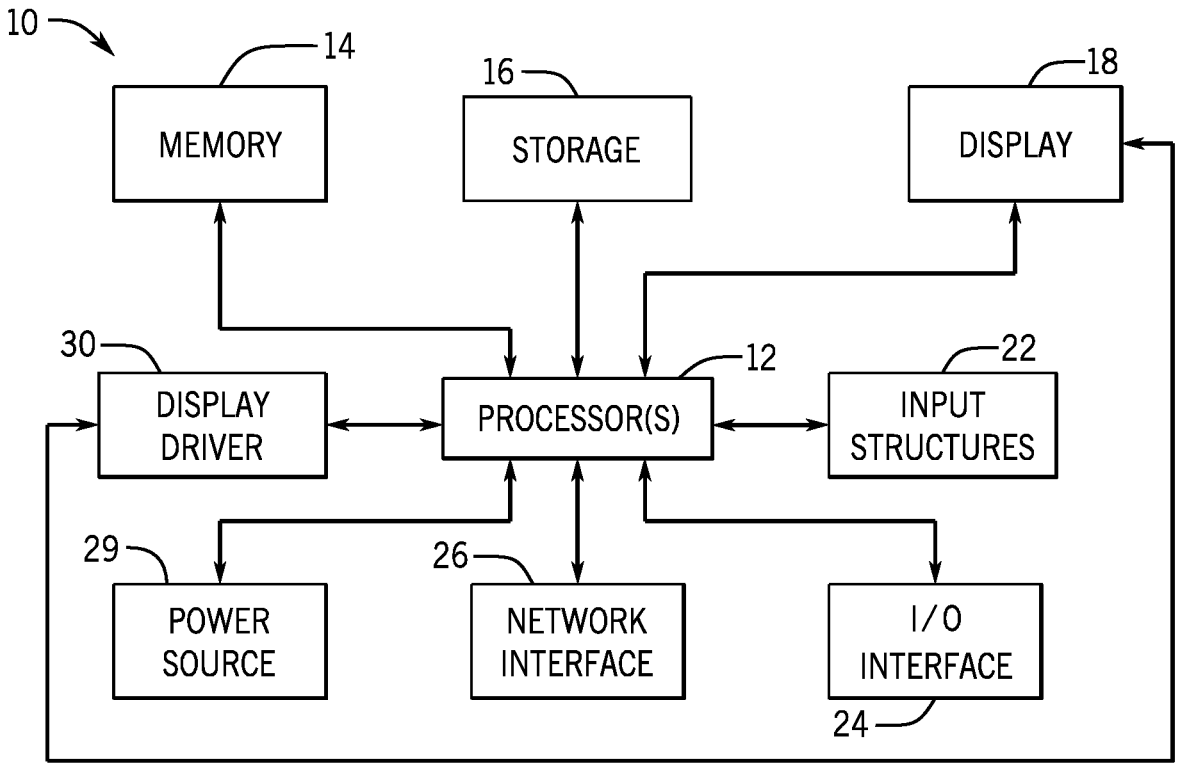
FIG. 1 is a block diagram of an electronic device including display control circuitry, in accordance with an embodiment.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

The present disclosure relates generally to electronic displays and, more particularly, to devices and methods for reducing visual artifacts related to luminance of a pixel at certain refresh rates of a light emitting diode (LED) electronic display.

Flat panel displays, such as liquid crystal display (LCD) panels and organic light emitting diode (OLED) panels are commonly used in a wide variety of electronic devices, including such consumer electronics as televisions, computers, and handheld devices (e.g., cellular telephones, audio and video players, gaming systems, and so forth). Such display panels typically provide a flat display in a relatively thin package that is suitable for use in a variety of electronic goods. Additionally, such devices may use less power than comparable display technologies, making them suitable for use in battery-powered devices or in other contexts where it is desirable to minimize power usage.

An OLED panel is a self-illuminating device that may utilize organic light emitting diodes when displaying image data. These diodes may be self-emissive by internally emitting light when current flows to a fluorescent organic compound or material. Generally, an electronic display may enable a user to perceive visual representations of information or an image by successively writing frames of image data to a display panel of the electronic display, such as those used for smartphones, tablets, televisions, etc. The OLED displays have a high response speed and high luminance to accommodate high refresh rates for image data depiction, but may display visual artifacts (e.g., flickering effects) at lower refresh rates.

As previously mentioned, an electronic device may use organic light emitting diode (OLED) displays, which may utilize passive matrix (PMOLED) diodes or active matrix (AMOLED) diodes. AMOLED displays use active matrix of OLED pixels generating light (e.g., luminance) upon electrical activation that may be integrated onto a thin-film transistor (TFT) array, which may act as a series of switches to control the current flowing to each individual pixel. Power consumption of LED displays may be reduced if the display refresh rate is reduced from, for example, 60 Hz to 30 Hz or even lower. This type of reduced refresh rate driving of the display may save driving power for the display, which may further enhance the battery life of the overall electronic device.

However, when a frame with a lower refresh rate is displayed for a low grey level image, the change in luminance may result in an image artifact, which may be perceived as flickering to the human eye. Low grey level images displayed at higher refresh rates may also experience luminance decay but flickering may not be observed since the frame may be refreshed quickly and light may be reemitted when the frame is refreshed. Brightness duration in sub-frames with low refresh rates may be increased to reduce the noticeability of any generated visual artifacts on the display. As used herein, "refresh rate" may refer to the frequency (e.g., in hertz [Hz]) at which frames of image data (e.g., first and second frames of image data, etc.) are written to an electronic display, or "refresh rate" may refer to the number of times that an image is refreshed per second.

To address observable flickering challenges in OLED or AMOLED architectures, as discussed above, embodiments presented herein describe methods for reducing visible flickering that may be caused by decaying pixel luminance when displaying certain image data (e.g., low grey level images) at low refresh rates. By adjusting or controlling light emission signals for an image frame displayed at a low refresh rate, the appearance of luminance and/or luminance decay as observed by the human eye may be adjusted, thereby reducing the ability of the human eye to detect flickers. For example, when the refresh rate is lower than some threshold, luminance may decay for longer since light is not reemitted, and by controlling the emission duration of light, the appearance of luminance decay that may cause observable flickering may also be controlled. As detailed below, method and system embodiments described below may employ pulse width modulation emission signals to extend pixel emissions for a frame of image data, thereby increasing the average luminance duration of a frame and reducing the chances of a human eye to view flicker effects in the displayed images.

With these features in mind, a general description of a suitable electronic device that may include a self-emissive display, such as a LED (e.g., an OLED or AMOLED) display, and corresponding circuitry of this disclosure is provided. Turning first to FIG. 1, a suitable electronic device 10 according to an embodiment of the present disclosure may include, among other things, one or more processor(s) 12, memory 14, storage 16, a display 18, input structures 22, an input/output (I/O) interface 24, a network interface 26, a power source 29, and a display driver 30. The various functional blocks shown in FIG. 1 may include hardware elements (including circuitry), software elements (including computer code stored on a computer-readable medium) or a combination of both hardware and software elements. It should be noted that FIG. 1 is merely one example of a particular implementation and is intended to illustrate the types of components that may be present in electronic device 10.

Figure 2:
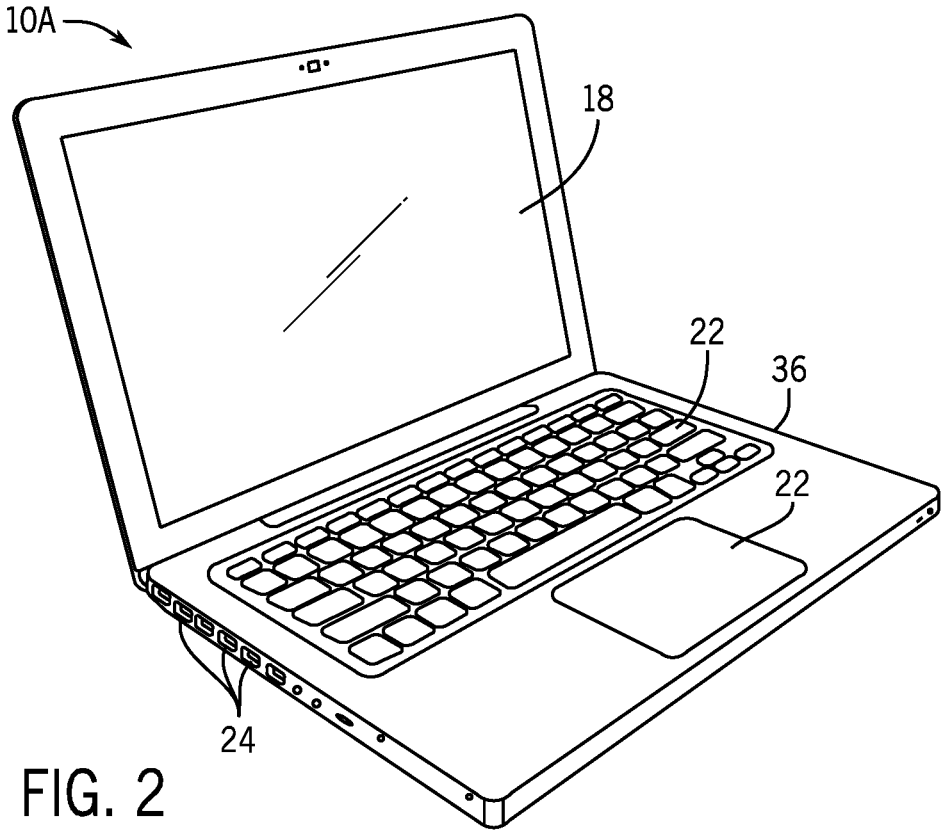
FIG. 2 is a perspective view of a notebook computer representing an embodiment of the electronic device of FIG. 1, in accordance with an embodiment.
Figure 4:
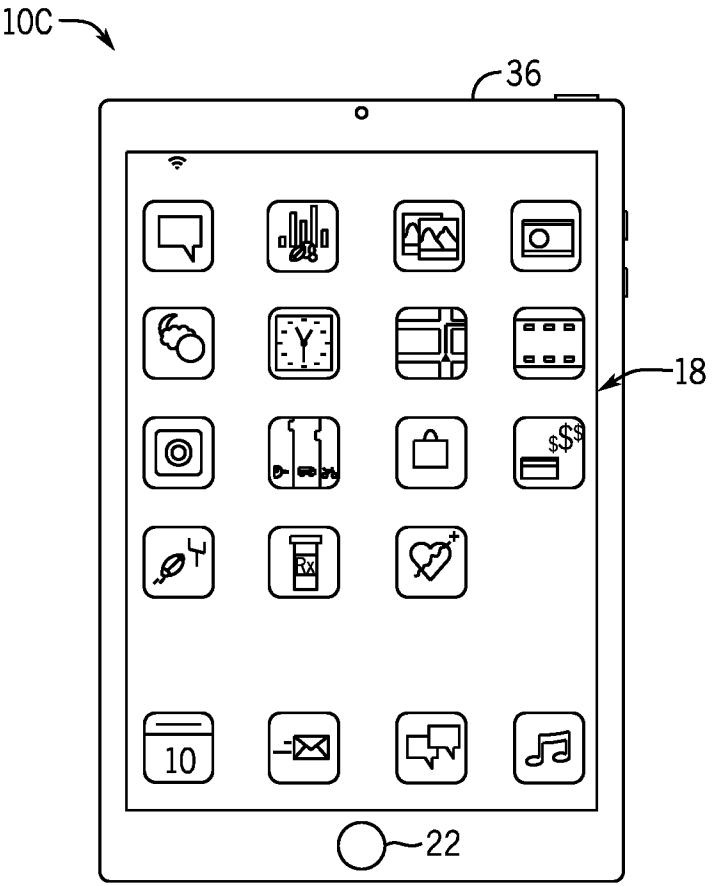
FIG. 4 is a front view of a hand-held tablet device representing another example of the electronic device of FIG. 1, in accordance with an embodiment.
Figure 3:
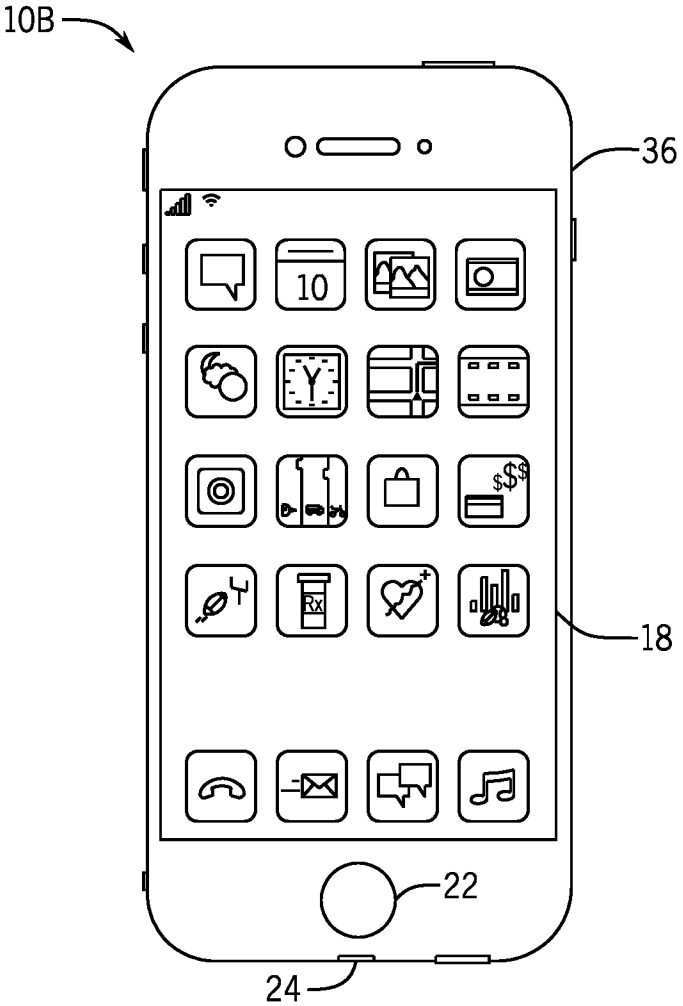
FIG. 3 is a front view of a hand-held device representing an example of the electronic device of FIG. 1, in accordance with an embodiment.
Figure 5:
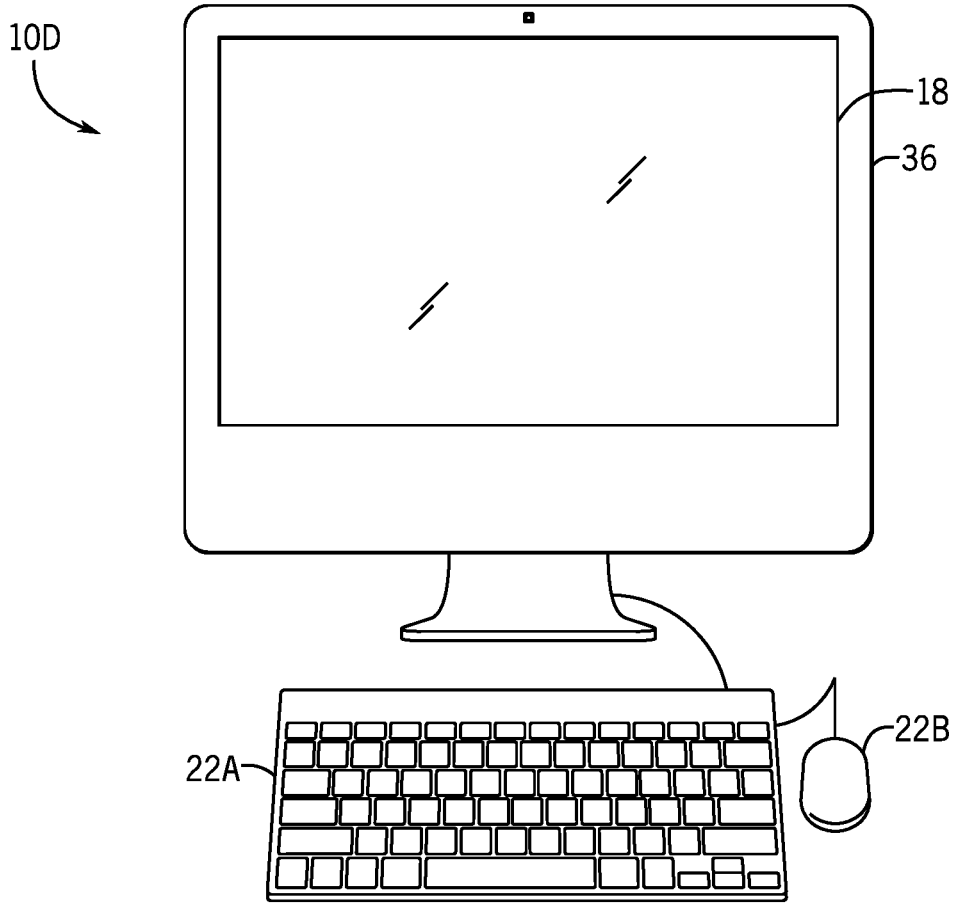
FIG. 5 is a front view of a desktop computer representing another embodiment of the electronic device of FIG. 1, in accordance with an embodiment.
Figure 6:
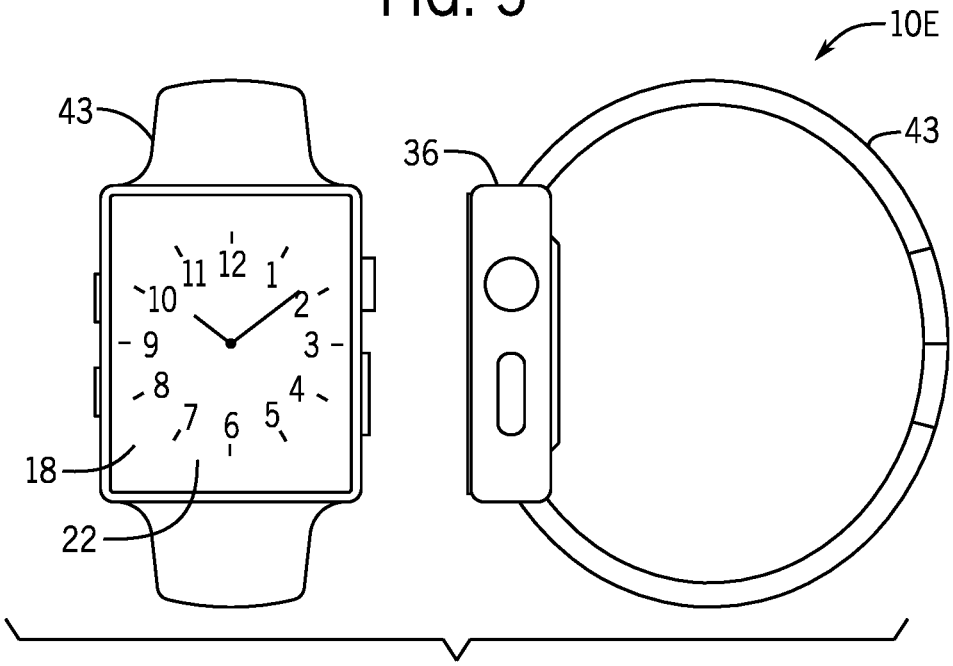
FIG. 6 is a front view of a wearable electronic device representing another example of the electronic device of FIG. 1, in accordance with an embodiment.

By way of example, the electronic device 10 may represent a block diagram of the notebook computer depicted in FIG. 2, the handheld device depicted in FIG. 3, the handheld device depicted in FIG. 4, the desktop computer depicted in FIG. 5, the wearable electronic device depicted in FIG. 6, or similar devices. It should be noted that the processor(s) 12 and other related items in FIG. 1 may be generally referred to herein as "data processing circuitry." Such data processing circuitry may be embodied wholly or in part as software, firmware, hardware, or any combination thereof. Furthermore, the data processing circuitry may be a single contained processing module or may be incorporated wholly or partially within any of the other elements within the electronic device 10.

In some embodiments, the processor(s) 12 of the electronic device 10 of FIG. 1 may perform various data processing operations, including generating and/or processing image data for display on the display 18, in combination with memory 14 and storage 16. For example, instructions (e.g., instructions for additional or pulse emission signals) that are executed by the processor 12 may be stored on the memory 14 and the storage 16. By way of example, the memory 14 and the storage 16 may include any suitable articles of manufacture for storing data and executable instructions, such as random-access memory, read-only memory, flash memory, a hard drive, and so forth. The processor 12 may include one or more microprocessors and/or application-specific microprocessors (ASICs), or a combination of such processing components. For example, the processor 12 may include one or more instruction set (e.g., reduced instruction set computer (RISC)) processors, as well as graphics processors (GPU), video processors, audio processors and/or related chip sets.

The electronic device 10 may include a display driver 30, which may include a chip, such as processor or ASIC, that may control various aspects of the display 18. It should be noted that the display driver 30 may be implemented in the CPU, the GPU, image signal processing pipeline, display pipeline, driving silicon, or any suitable processing device that is capable of processing image data in the digital domain before the image data is provided to the pixel circuitry.

In certain embodiments, the display driver 30 may drive emission signals to counter the display artifacts caused by the decaying luminance signals (e.g., voltage or current) that are more visible in pixels of the display 18 that are refreshed at a relatively lower refresh rate (e.g., less than 60 Hz). Generally, when emitting the same color or gray level in a pixel or collection of pixels over a period of frames of image data, the same electrical signal (e.g., voltage or current) is provided to the respective pixel or pixels of the display 18. Although each pixel should emit the same luminance properties over the period of frames, the electrical signal may decay or increase due to capacitive or inductive loads present on the pixel circuit. This decay or increase of the electrical signal provided to the pixel circuit at each frame may cause a human eye to view flickers in the display 18. The flicker effect is more visible as the refresh rate for the display 18 is decreased. However, as will be described in more detail below, the display driver 30 may send emission signals to pixel circuits to cause the respective pixels to emit light for an extended duration than they normally emit light to depict a particular gray level. This extension of emission time may reduce the appearance of the flickering effect by compensating for the decaying luminance of a pixel during each frame of image data.

The electronic device 10 may use the network interface 26 to communicate with various other electronic devices or elements. The network interface 26 may include, for example, one or more interfaces for a personal area network (PAN), such as a Bluetooth network, for a local area network (LAN) or wireless local area network (WLAN), such as an 802.11x Wi-Fi network, and/or for a wide area network (WAN), such as a 3rd generation (3G) cellular network, 4th generation (4G) cellular network, long term evolution (LTE) cellular network, long term evolution license assisted access (LTE-LAA) cellular network. The I/O interface 24 may enable electronic device 10 to interface with various other electronic devices, as may the network interface 26.

Using pixels containing LEDs (e.g., OLEDs or AMOLEDs), the display 18 may show images generated by the processor 12. The display 18 may include touchscreen functionality for users to interact with a user interface appearing on the display 18. Input structures 22 may also enable a user to interact with the electronic device 10. In some examples, the input structures 22 may represent hardware buttons, which may include volume buttons or a hardware keypad.

As further illustrated, the electronic device 10 may include a power source 29. The power source 29 may include any suitable source of power for the electronic device 10. This may include a battery within the electronic device 10 and/or a power conversion device to accept alternating current (AC) power from a power outlet.

As may be appreciated, the electronic device 10 may take a number of different forms. In certain embodiments, the electronic device 10 may take the form of a computer, a portable electronic device, a wearable electronic device, or other type of electronic device. Such computers may include computers that are generally portable (such as laptop, notebook, and tablet computers) as well as computers that are generally used in one place (such as conventional desktop computers, workstations, and/or servers). In certain embodiments, the electronic device 10 in the form of a computer may be a model of a MacBook®, MacBook® Pro, MacBook Air®, iMac®, Mac® mini, or Mac Pro® available from Apple Inc. By way of example, the electronic device 10, taking the form of a notebook computer 10A, is illustrated in FIG. 2. The depicted computer 10A may include a housing or enclosure 36, a display 18, input structures 22, ports of an I/O interface 24, and a display driver 30. In one embodiment, the input structures 22 (such as a keyboard and/or touchpad) may be used to interact with the computer 10A, such as to start, control, or operate a graphical user interface (GUI) or applications running on computer 10A. For example, a keyboard and/or touchpad may allow a user to navigate a user interface or application interface displayed on display 18.

FIG. 3 depicts a front view of a handheld device 10B, which represents one embodiment of the electronic device 10. The handheld device 10B may represent, for example, a portable phone, a media player, a personal data organizer, a handheld game platform, or any combination of such devices. By way of example, the handheld device 10B may be a model of an iPod® or iPhone® available from Apple Inc. of Cupertino, Calif. The handheld device 10B may include an enclosure 36 to protect interior components from physical damage and to shield them from electromagnetic interference. The enclosure 36 may surround the display 18. The I/O interfaces 24 may open through the enclosure 36 and may include, for example, an I/O port for a hardwired connection for charging and/or content manipulation using a standard connector and protocol, such as the Lightning connector provided by Apple Inc., a universal serial bus (USB), or other similar connector and protocol.

User input structures 22, in combination with the display 18, may allow a user to control the handheld device 10B. For example, the input structures 22 may activate or deactivate the handheld device 10B, navigate user interface to a home screen, a user-configurable application screen, and/or activate a voice-recognition feature of the handheld device 10B. Other input structures 22 may provide volume control or may toggle between vibrate and ring modes. The input structures 22 may also include a microphone that may obtain a user's voice for various voice-related features, and a speaker that may enable audio playback and/or certain phone capabilities. The input structures 22 may also include a headphone input that may provide a connection to external speakers and/or headphones.

FIG. 4 depicts a front view of a handheld tablet device 10C, which represents another embodiment of the electronic device 10. The handheld tablet device 10C may represent, for example, a tablet computer, or one of various portable computing devices. By way of example, the handheld device 10C may be a tablet-sized embodiment of the electronic device 10, which may be, for example, a model of an iPad® available from Apple Inc. of Cupertino, Calif. The handheld device 10C may also include an enclosure 36 that holds the electronic display 18. Input structures 22 may include, for example, a hardware or virtual home button.

Turning to FIG. 5, a computer 10D may represent another embodiment of the electronic device 10 of FIG. 1. The computer 10D may be any computer, such as a desktop computer, a server, or a notebook computer, but may also be a standalone media player or video gaming machine. By way of example, the computer 10D may be an iMac®, a MacBook®, or other similar device by Apple Inc. It should be noted that the computer 10D may also represent a personal computer (PC) by another manufacturer. A similar enclosure 36 may be provided to protect and enclose internal components of the computer 10D such as the display 18. In certain embodiments, a user of the computer 10D may interact with the computer 10D using various peripheral input devices, such as the keyboard 22A or mouse 22B (e.g., input structures 22), which may connect to the computer 10D.

Similarly, FIG. 6 depicts a wearable electronic device 10E representing another embodiment of the electronic device 10 of FIG. 1 that may be operated using the techniques described herein. By way of example, the wearable electronic device 10E, which may include a wristband 43, may be an Apple Watch® by Apple Inc. More generally, the wearable electronic device 10E may be any wearable electronic device such as, for example, a wearable exercise monitoring device (e.g., pedometer, accelerometer, heart rate monitor), or other device by another manufacturer. The display 18 of the wearable electronic device 10E may include a touch screen display 18 (e.g., LCD, OLED display, active-matrix organic light emitting diode (AMOLED) display, and so forth), as well as input structures 22, which may allow users to interact with a user interface of the wearable electronic device 10E.

Electronic devices 10A, 10B, 10C, 10D, and 10E described above may utilize pulse width modulation emission signals to increase the emission period during frames of image data that are depicted using low refresh rates to reduce visual artifacts generated on a display 18. As will be described herein, by extending the emission period for a pixel during a frame of image data, the average luminance of the frame of sub-frames may increase and reduce the display flickering effects that may otherwise be detected by a human eye viewing the image data presented on the display.

Figure 7:
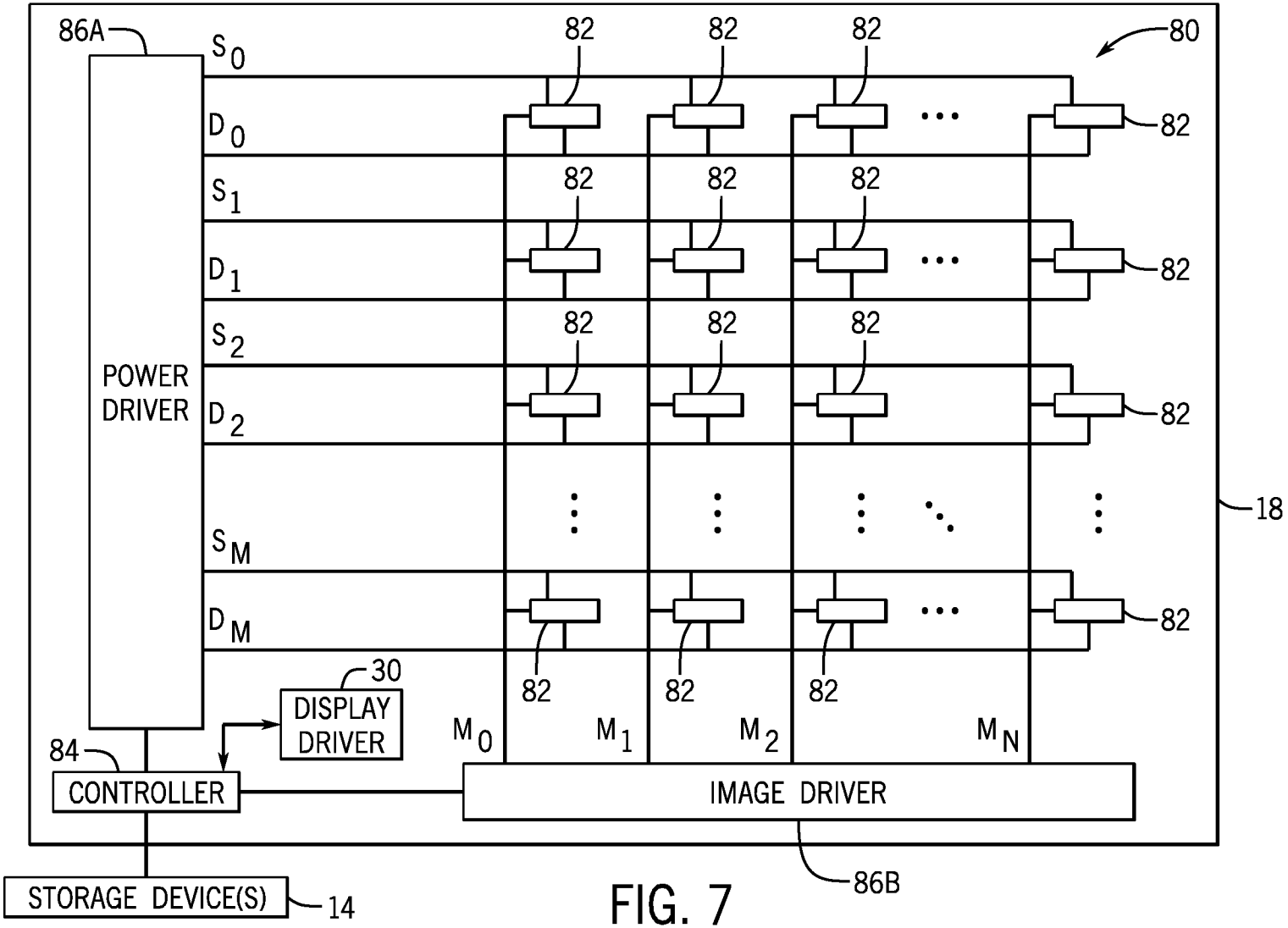
FIG. 7 is circuit diagram of the display of the electronic device of FIG. 1, in accordance with an embodiment.

As shown in FIG. 7, the display 18 may include a pixel array having an array of one or more pixels 82. The display 18 may include any suitable circuitry to drive the pixels 82. In the example of FIG. 7, the display 18 includes a controller 84, a power driver 86A, an image driver 86B, and the array of the pixels 82. The power driver 86A and image driver 86B may drive individual luminance of the pixels 82. In some embodiments, the power driver 86A and the image driver 86B may include multiple channels for independent driving of the pixel 82. Each of the pixels 82 may include any suitable light emitting element, such as a LED, one example of which is an OLED. However, any other suitable type of pixel may also be used. Although the controller 84 is shown in the display 18, the controller 84 may be located outside of the display 18 in some embodiments. For example, the controller 84 may also be located in the processor 12.

The scan lines S0, S1, . . . , and Sm and driving lines D0, DI, . . . , and Dm may connect the power driver 86A to the pixel 82. The pixel 82 may receive on/off instructions through the scan lines S0, S1, . . . , and Sm and may generate programming voltages corresponding to data voltages transmitted from the driving lines D0, D1, . . . , and Dm. The programming voltages may be transmitted to each of the pixels 82 to emit light according to instructions from the image driver 86B through driving lines M0, M1, . . . , and Mn. Both the power driver 86A and the image driver 86B may be transmitting voltage signals at programmed voltages through respective driving lines to operate each pixel 82 at a state determined by the controller 84 to emit light. Each driver may supply voltage signals at a duty cycle and/or amplitude sufficient to operate each pixel 82.

The intensities of each of the pixels 82 may be defined by corresponding image data that defines particular gray levels for each of the pixels 82 to emit light. A gray level indicates a value between a minimum and a maximum range, for example, 0 to 255, corresponding to a minimum and maximum range of light emission. Causing the pixels 82 to emit light according to the different gray levels causes an image to appear on the display 18. In this manner, a first brightness of light (e.g., at a first luminosity and defined by a gray level) may emit from a pixel 82 in response to a first value of the image data and the pixel 82 may emit a second brightness of light (e.g., at a second luminosity) in response to a second value of the image data. Thus, image data may create a perceivable image output through indicating light intensities to apply to individual pixels 82.

The controller 84 may retrieve image data stored in the storage 16 indicative of light intensities for the colored light outputs for the pixels 82. In some embodiments, the processor 12 may provide image data directly to the controller 84. The image data may indicate the pixel light intensity and/or refresh rate data. For example, the controller 84 may receive an indication of the refresh rate of the display 80, a desired refresh rate of the display 80, frame and sub-frame period duration, or desired pixel luminance. The controller 84 may control the pixel 82 by using control signals to control elements of the pixel 82. The display driver 30 coupled to the controller 84 may also receive the image data (e.g., light intensity, frame refresh rate, etc.) generated by the processor and generate a control signal to extend the emission duration of an emission signal used to emit light during a frame of image data. As a result, the observable effect of flickering due to the luminance decay properties of the pixels 82 may be reduced.

In some embodiments, the controller 84 may use a brightness control signal to drive pixel light intensity via the controller 84, and the display driver 30 may use a separate emission control signal to control when the pixel 82 emits light during a frame of image data or during sub-frames of the frame of image data. The display driver 30 may provide the emission control data to the controller 84, which may then transmit corresponding data signals to the self-emissive pixels 82, such that the self-emissive pixels 82 may emit light during additional sub-frames of a frame of image data, thereby depicting a brighter average luminance to the human eye, as provided in accordance with the techniques that will be described in detail below.

The pixel 82 may include any suitable controllable element, such as a transistor, one example of which is a metal-oxide-semiconductor field-effect transistor (MOSFET). However, any other suitable type of controllable elements, including thin film transistors (TFTs), p-type and/or n-type MOSFETs, and other transistor types, may also be used.

Figure 8:
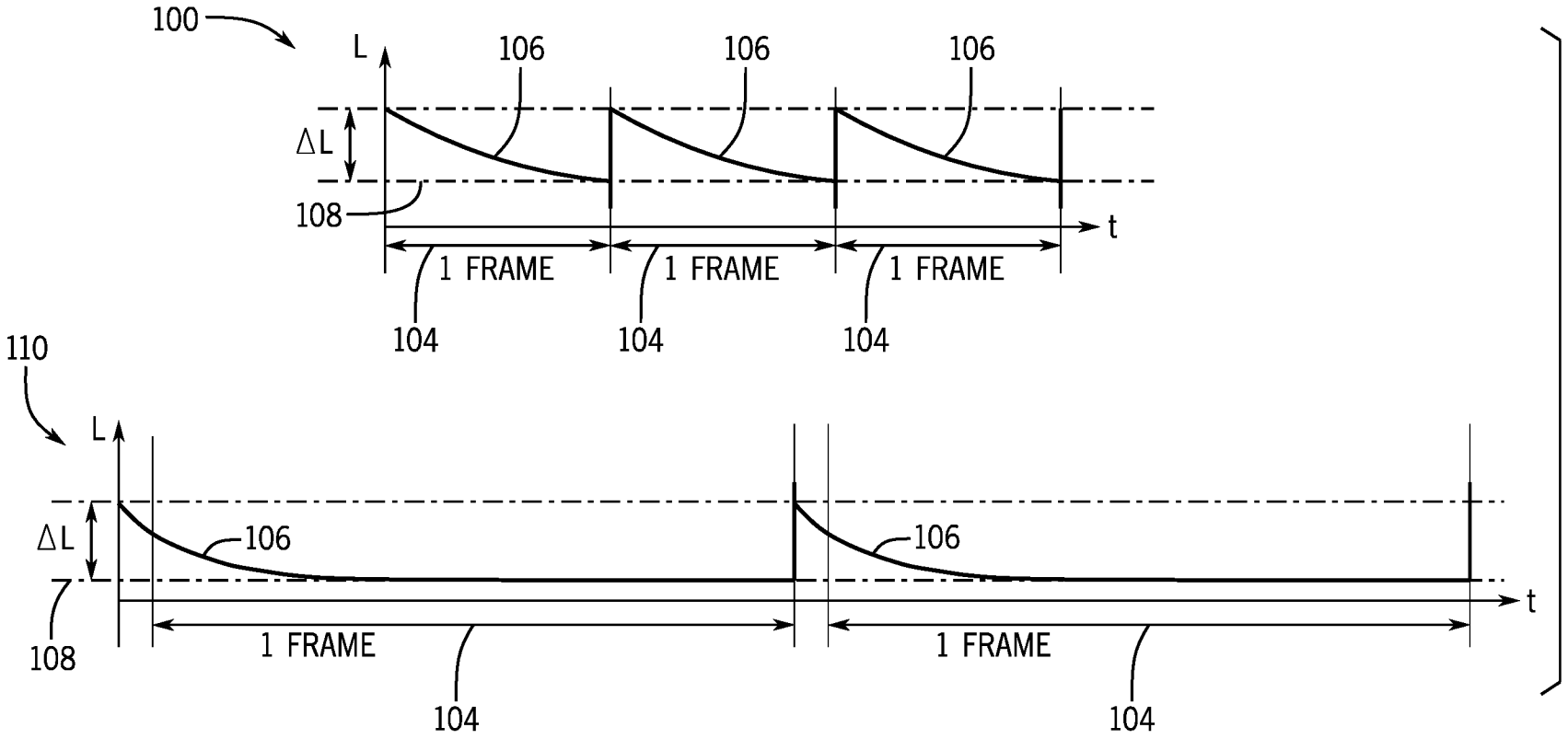
FIG. 8 is a diagram of luminance of frames displayed at a high refresh rate and at a low refresh for a low grey level image displayed on the electronic device of FIG. 1, in accordance with an embodiment.

To illustrate effects on luminance of pixels depicting an image, FIG. 8 includes a first graph 100 and a second graph 110 of example luminance decays (e.g., luminance decay curve) of the pixel 82 during frames of image data that depict the same gray level or color. For example, the graph 100 depicts frames 104 refreshed at a refresh rate higher than the refresh rate of the frames 104 depicted in the graph 110. As shown in the graph 100, the luminance intensity 106 highest at the beginning of the frame 104 and decays (e.g., reduces) over time. Towards the end of the frame 104 duration, the decay may be at its lowest point before another frame 104 is initialized by the display 80. Each time the frame 104 is depicted in the display 18, the pixel may be controlled via the controller 84 to resend light emission signals. Therefore, prior to the luminance intensity 106 decaying below a luminance baseline 108, another frame 104 of image data may be processed and the respective pixels 82 of the display 18 may receive another emission signal and a corresponding data signal (e.g., voltage or current signal) that corresponds to the desired gray level. Although the luminance or brightness decays over the course of each frame 104 in the graph 100, a human eye may not notice or process the luminance decay because the frames 104 are refreshed at a rate in which the human eye may not perceive the difference in luminance between the end of one frame 104 and the beginning of another frame 104.

On the other hand, the graph 110 depicts pixel luminance of the frames 104 refreshed at a lower refresh rate as compared to the graph 100. As previously shown, the luminance intensity 106 is the highest at the beginning of a frame 104 and decays (e.g., dims) over time to the luminance baseline 108. However, unlike the higher refresh rate frames 104 of the graph 100, the lower refresh rate frames 104 may remain at the luminance threshold before another frame 104 is sent to the display 18. Therefore, after the luminance intensity 106 changes over the course of the frame 104 and decays to the luminance baseline 108, the frame 104 does not refresh to increase the luminance value quickly enough before flickering effects may be observed by a viewer.

Figure 9:
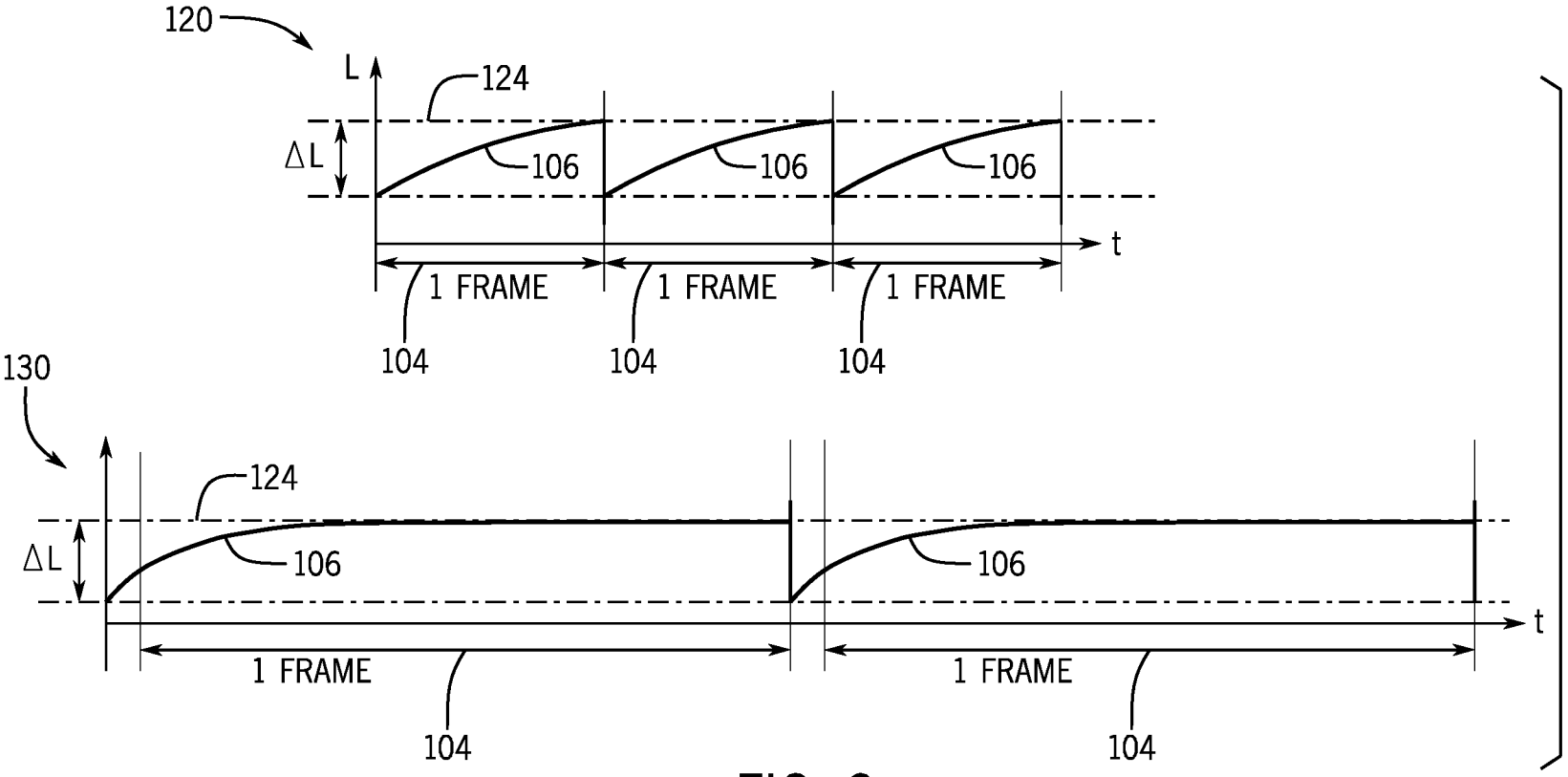
FIG. 9 is a diagram of pixels driving to a higher luminance of frames displayed at a high refresh rate and at a low refresh rate for a low grey level image displayed on the electronic device of FIG. 1, in accordance with an embodiment.

It should also be noted that the flicker effects or visual artifacts may also be visible with pixels 82 that receive a data signal (e.g., voltage or current) and increase during the frame 104. For instance, FIG. 9 illustrates a first graph 120 and a second graph 130 indicative of a luminance increase of the pixel 82 similar to that of the luminance decay described above. As shown, the luminance intensity 106 may start off low at the beginning of a frame 104 and drive up to the brightest level of a luminance towards the end of the frame 104. The highest point of the luminance intensity 106 may correspond to a luminance threshold 124. Like the luminance decay described above, in higher refresh rate operations, a flicker effect or visual artifacts may not be visible to a human eye since the relative time in which the luminance intensity 106 increases over the frame 104 is too short for a person to detect the increase. On the other hand, the frames 104 refreshed at a lower refresh rate, as shown in the graph 130, may remain closer to the luminance threshold 124 for a longer relative period of time, thereby increasing the perception of the change in luminance, thus causing visual artifacts such as flickers.

With the foregoing in mind, the presently disclosed embodiments may reduce the visibility of the visual artifacts, such as flickering, by increasing the amount of time that the pixel 82 emits light during the frame 104 of image data. That is, in some embodiments, the display driver 30 may control the emission signal provided to the pixel 82, such that pixel 82 emits light for a longer period of time, as normally used to depict a particular grey level. By increasing the amount of time that the pixel 82 emits light during the frame 104, the viewer of the display 18 may be less likely to detect the change in luminance intensity 106.

Figure 10:
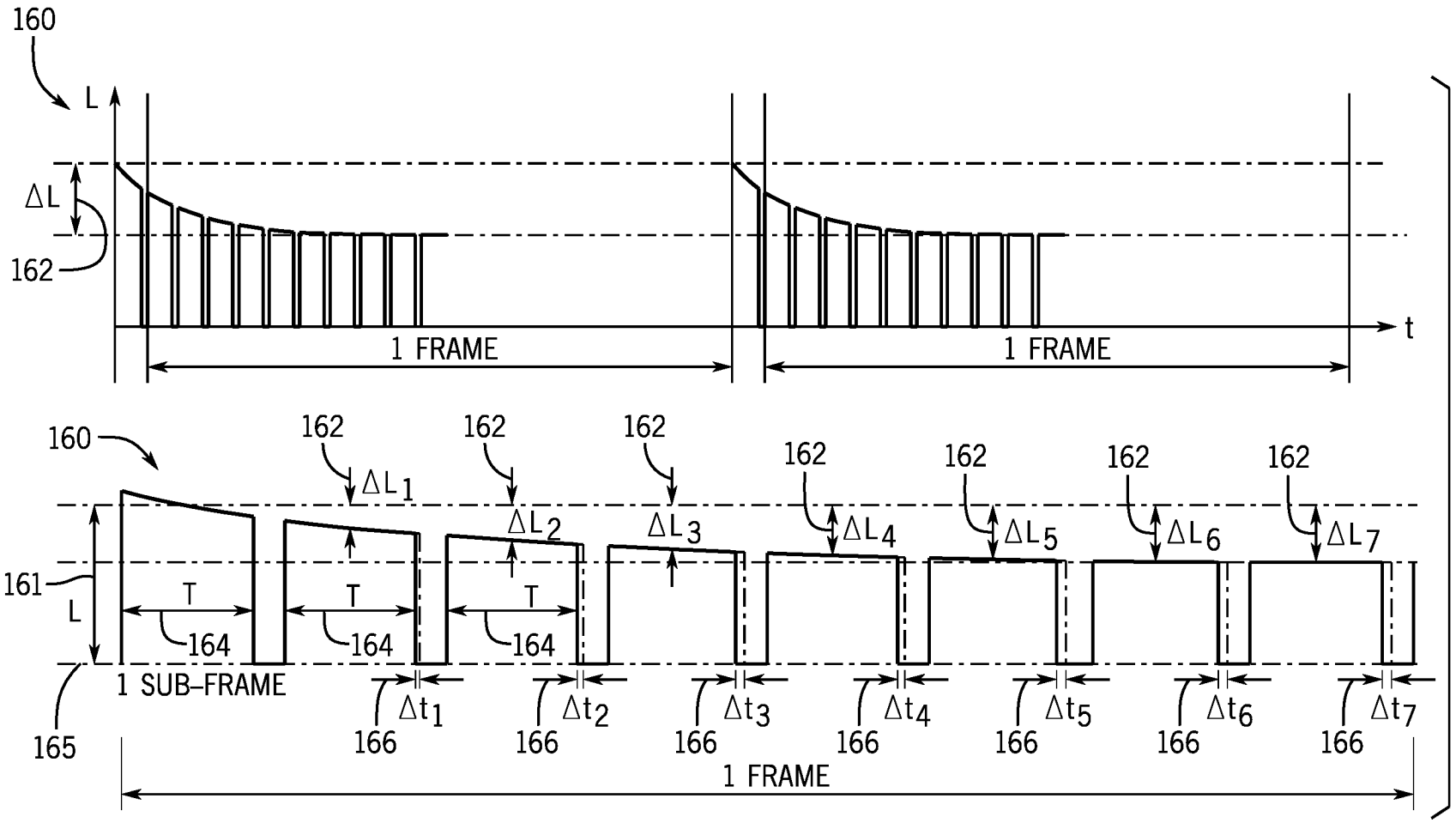
FIG. 10 is block diagram of sub-frames that use emission signals to extend the luminance duration of the sub-frames, in accordance with an embodiment.

To illustrate, FIG. 10 illustrates an embodiment in which the display driver 30 may extend luminance duration of the pixel 82 during a frame of image data using emission signals. In some embodiments, the display driver 30 or other suitable circuit may determine an amount of time to extend the emission of the pixel 82 based on luminance parameters, as will be discussed in greater detail below.

With the forgoing in mind, the display driver 30, the controller 84, or other suitable circuit may employ a machine-executable algorithm to determine the luminance parameters and emission duration extension. Based on the emission duration extension, the display driver 30 or other suitable component may send pulsing emission signals to the pixel 82 to emit light during the extension period. For the purposes of discussion, the following description of the emission duration extension, the emission signal transmission, and the like will be detailed as being performed by the display driver 30, but it should be understood that any suitable component may perform these tasks.

As shown in graph 160 of FIG. 10, emission periods for the pixel 82 during a frame of image data may be divided into multiple sub-frames. That is, the display driver 30 may send emission signals during the sub-frames to enable the pixel 82 to emit light. As discussed above, the luminance value for a frame of image data may be highest at the beginning of the frame period and decays as time passes. By adjusting the emission duration of one or more sub-frames, the display driver 30 may increase the overall luminance duration and luminance average of the frame, thereby reducing the probability that a flicker or visual artifact will be visible to a viewer. In this manner, low refresh rates may still be used to preserve power consumption of the display 18 without presenting image artifacts.

As mentioned above, the display driver 30 may control the extended emission duration by the number of emission signals transmitted to the pixel 82. In some embodiments, the extended emission duration may be determined based on certain luminance parameters. For example, the emission duration extension may be described using the following equation:

$$(L-\Delta L_n)*\Delta t_n=\Delta L_n*T \quad \text{(Equation 1)}$$

where n corresponds to a respective sub-frame (e.g., n=0 for a first sub-frame, n=1 for a second sub-frame, etc.), error 162 ($\Delta L_n$) corresponds to an error of luminance between an initial luminance level 161 (L) and the luminance baseline 165 of the frame, time 164 (T) corresponds to a time period of a sub-frame, and $\Delta t_n$ corresponds to the emission duration extension 166. Thus, the amount of emission duration extension 166 may be determined by:

$$\Delta t_n=(\Delta L_n*T)/(L-\Delta L_n) \quad \text{(Equation 2)}$$

According to Equation 2 above, the display driver 30 may determine an amount of time to extend the emission period for each sub-frame. Although extending the time in which emission signals are transmitted to the pixel 82 does not change the trend of luminance decay, the increase in the total amount of time in which the pixel 82 emits light may reduce the appearance of flickering.

With this in mind and referring again to FIG. 12, the display driver 30 may add the emission duration extension, $\Delta t_n$ 166 to the time 164 (T) of a respective sub-frame. The emission duration extension $\Delta t_n$ 166 may be added to the beginning of a sub-frame or the end of the sub-frame. It should be noted that adding the emission duration extension $\Delta t_n$ 166 after the last sub-frame of a frame may difficult if there is not enough time prior to the start of the next frame. In the same manner, it should be noted that adding the emission duration extension $\Delta t_n$ 166 prior to the first sub-frame of a frame may difficult if there is not enough time after the end of the preceding frame.

In any case, by adding the emission duration extension $\Delta t_n$ 166 to each respective sub-frame, the luminance emission duration during each respective sub-frame of the given frame increases, thereby reducing the effect of the decaying luminance properties of a frame of image data may have on a viewer. Indeed, the average luminance of a frame may appear brighter since the light emission duration is increased by extending the emission duration for each sub-frame.

To adjust the emission period of the pixel 82 based on the emission duration extension $\Delta t_n$, the display driver 30 may adjust the transmission of emission signals to the pixel 82. By way of example, FIG. 11 illustrates three embodiments of pixel circuits 180A, 180B, and 180C of the pixel 82 that may transmit the emission signals generated by the display driver 30, the controller 84, or other suitable component.

Figure 11:
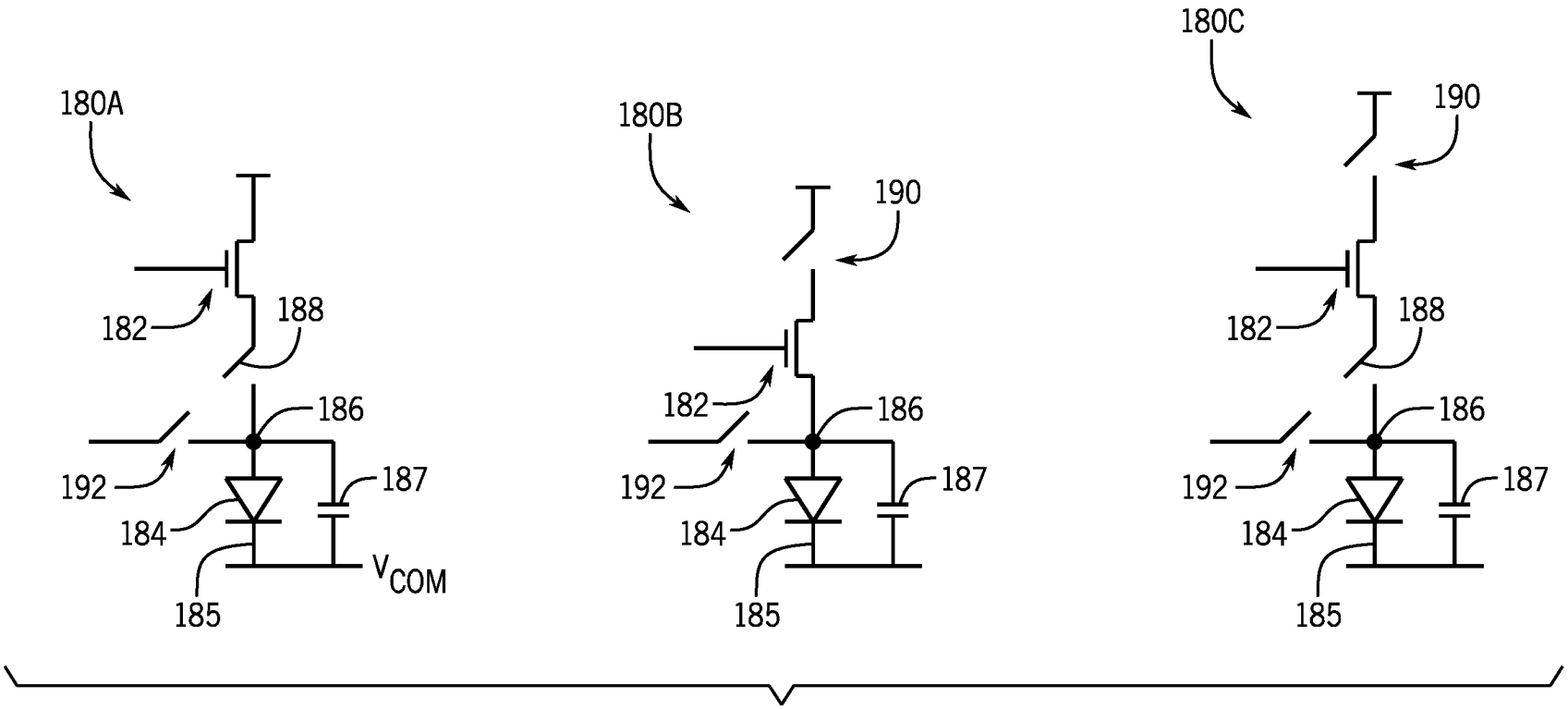
FIG. 11 is a circuit diagram of emission pulse width control in a display pixel, in accordance with an embodiment.

The display pixels 82 of FIG. 11 each include the circuit switching TFT 182, either as a P-type TFT (e.g., activated by an active low gate signal to transmit the source value to the drain) or an N-type TFT (e.g., activated as by an active low gate signal to transmit the source value to the drain). Also illustrated is LED 184 that may be used in the OLED or AMOLED display 18, having an anode 186 coupled to a first emission switch 188. When the first emission switch 188 is closed, the anode 186 may be coupled to the drain of the TFT 182 and a cathode 185, which may be coupled to, for example, a common voltage, Vcom. Also illustrated in FIG. 11 is a parasitic capacitance of the LED 184 as COLED capacitor 187. In operation, a leakage current (e.g., as temperatures increase) of the TFT 182 may be present and may continuously charge the anode 186 (e.g., the LED capacitor 187), such that the voltage at the anode 186 approaches a turn-on voltage for the LED 184. After the voltage at the anode 186 is equal to or greater than a turn-on voltage for the LED 184, emission of light from the LED 184 will occur. In some embodiments, a reset switch 192 may be utilized to reset the voltage at the anode 186 to a predetermined value below the turn-on voltage for the LED 184. Closing of the reset switch 192 may cause the voltage of the anode 186 to be reset to a predetermined anode reset voltage level at regular intervals, which may correspond to the refresh rate of the display 18 (e.g., 60 Hz). Thus, the reset switch 192 may be used (e.g., open or closed) for frame refreshing for a given refresh rate.

To alleviate potential image artifact issues associated with low refresh rates for low grey level images being displayed on display 18 as discussed above, an emission control signal may be used to activate an emission of light at each pixel using pulse width modulation. That is, light is emitted by the pixel 82 with each pulse, and the emission duration of sub-frames may be extended in accordance with the embodiments described above to increase the average luminance of a respective frame. For instance, the first emission switch 188 of the pixel circuit 180A may be closed to send an emission signal to the LED 184, a second emission switch 190 of the pixel circuit 180B may be closed to send an emission signal to the LED 184, or both the first emission switch 188 and the second emission switch 190 of the pixel circuit 180C may be closed to send an emission signal to the LED 184.

In some embodiments, the emission signal may be a pulse width modulation signal, which may send a voltage signal to drive the brightness of the pixel. As described in FIG. 7, the pixel 82 may receive on/off instructions through the scan lines (e.g., Sm) and may generate programming voltages corresponding to data voltages transmitted from the driving lines (e.g., Dm). The programming voltages may be transmitted to each of the pixel 82 to emit light according to instructions from the image driver 86B through driving lines (e.g., Mn). Both the power driver 86A and the image driver 86B may be transmitting voltage signals at programmed voltages through respective driving lines to operate each pixel 82 at a state determined by the controller 84 to emit light. In this example, the display driver 30 or other suitable component may determine that the frames displaying an image are displayed at a low refresh rate. In response to the low refresh rate of the display 18, the display driver 30 may control the first emission switch 188 and/or the second emission switch 190 of the respective circuit according to the emission duration extension $\Delta t_n$ 166 described above. That is, the display driver 30 may control the switches 188 and 190 to emit during the sub-frames of the frame of image data and extend each respective sub-frame emission period according to the respective emission duration extension $\Delta t_n$ 166.

Figure 12:
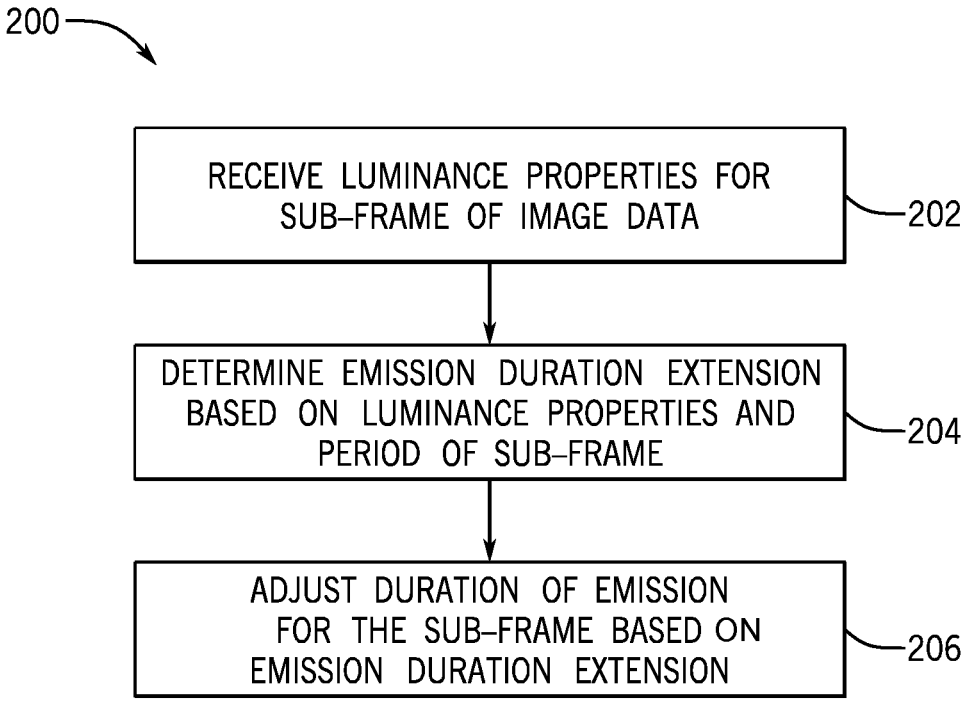
FIG. 12 is a flow diagram of a method for extending the average luminance duration of frames displayed at a low-refresh rate for a low grey level image.

Keeping the foregoing in mind, FIG. 12 illustrates a process 200 for controlling an emission signal for each sub-frame of a frame of image data, in accordance with the embodiments described herein. Although the process 200 is described as being performed by the display driver 30, it should be noted that any suitable device may perform the operations described herein. Additionally, although the process 200 is described as being performed in a particular order, it should be noted that the process 200 may be performed in other suitable orders.

Referring to FIG. 12, the display driver 30 of the electronic device 10 may receive (block 202) luminance properties or characteristics for a sub-frame of a frame image data. The luminance properties may correspond to a desired grey level for the frame of image data, a luminance for the sub-frame, a peak luminance of the frame of image data, a luminance baseline for the frame of image data, and the like. In addition, the luminance properties may include properties of the sub-frame, such as the error luminance162, $\Delta L_n$, between a desired luminance level 161, and the luminance intensity of the given displayed sub-frame, the time 164 period of a sub-frame and sub-frames, and the like.

Based on these luminance parameters of the sub-frames, the display driver 30 may determine (block 204) an amount of emission duration extension, $\Delta t_n$ 166 for each sub-frame, according to Equation 2 above. The emission duration extension 166, $\Delta t_n$, may be used to determine the amount or number of pulsing for emitting light for the additional time periods. After determining the emission duration extension 166, the display driver 30 may adjust (block 206) duration of emission for the sub-frame based on the determined emission duration extension by emitting light with each pulse using emission switches 188 and 190, as described above. The process 200 may allow the overall luminance emitted for the duration of frame sub-frame, and thus, the overall frame period, to increase and appear brighter, removing any noticeable flickering that may be experienced with low fresh rates for low grey level images.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ," it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A display device, comprising:

a display comprising a plurality of pixels; and a processor configured to:

receive image data to be displayed via the plurality of pixels, wherein the image data comprises pixel luminance data for a frame of the image data;

determine an emission duration for a pixel of the plurality of pixels during a sub-frame of the frame based on the pixel luminance data;

determine an emission duration extension to apply to the emission duration associated with the sub-frame based on a luminance baseline associated with the sub-frame, a luminance level associated with the sub-frame, and a time period associated with the sub-frame, wherein the luminance baseline corresponds to a lowest point in a luminance decay curve associated with the frame, and wherein the luminance level corresponds to an initial luminance level at a start of the sub-frame; and send an emission signal to the pixel, wherein the emission signal is configured to cause the pixel to emit light for a duration that corresponds to the emission duration and the emission duration extension.

2. The display device of claim 1, wherein the processor is configured to determine the emission duration extension in response to a refresh rate of the display being below a threshold.

3. The display device of claim 2, wherein the threshold is 30 Hz or below.

4. The display device of claim 1, wherein the processor is configured to apply the emission duration extension at a beginning of the sub-frame, wherein the sub-frame is not positioned at a beginning of the frame.

5. The display device of claim 1, wherein the processor is configured to apply the emission duration extension at an end of the sub-frame, wherein the sub-frame is not positioned at an end of the frame.

6. The display device of claim 1, wherein the processor is configured to send a plurality of emission signals to the pixel in a pulse width modulation pattern, wherein the plurality of emission signals corresponds to a plurality of sub-frames that corresponds to the frame.

7. The display device of claim 1, wherein the pixel luminance data is below a threshold.

8. The display device of claim 1, wherein the emission duration extension is determined based on a difference between the luminance level and the luminance baseline.

9. A method, comprising:

receiving, via a processor, image data to be displayed via a plurality of pixels in a display, wherein the image data comprises pixel luminance data for a frame of the image data;

determining, via the processor, an emission duration for a pixel of the plurality of pixels during a sub-frame of the frame based on the pixel luminance data;

determining, via the processor, an emission duration extension to apply to the emission duration associated with the sub-frame based on a luminance baseline associated with the sub-frame, a luminance level associated with the sub-frame, and a time period associated with the sub-frame, wherein the luminance baseline corresponds to a lowest point in a luminance decay curve associated with the frame, and wherein the luminance level corresponds to an initial luminance level at a start of the sub-frame; and sending, via the processor, an emission signal to the pixel, wherein the emission signal is configured to cause the pixel to emit light for a duration that corresponds to the emission duration and the emission duration extension.

10. The method of claim 9, wherein the pixel luminance data corresponds to a grey level to be depicted by the pixel during the frame.

11. The method of claim 9, wherein the emission duration extension is determined in response to a refresh rate of the display being below a threshold.

12. The method of claim 11, wherein the threshold is 30 Hz or below.

13. A display driver, configured to:

receive image data to be displayed via a plurality of pixels of a display, wherein the image data comprises pixel luminance data for a frame of the image data;

determine an emission duration for a pixel of the plurality of pixels during a sub-frame of the frame based on the pixel luminance data;

determine an emission duration extension to apply to the emission duration associated with the sub-frame based on a luminance baseline associated with the sub-frame, a luminance level associated with the sub-frame, and a time period associated with the sub-frame, wherein the luminance baseline corresponds to a lowest point in a luminance decay curve associated with the frame, and wherein the luminance level corresponds to an initial luminance level at a start of the sub-frame; and send an emission signal to the pixel, wherein the emission signal is configured to cause the pixel to emit light for a duration that corresponds to the emission duration and the emission duration extension.

14. The display driver of claim 13, configured to selectively enable a first switch of pixel circuitry to send the emission signal to the pixel.

15. The display driver of claim 14, configured to selectively enable the first switch and a second switch of the pixel circuitry to send the emission signal to the pixel.

16. The display driver of claim 13, wherein the luminance level decays over the time period associated with the sub-frame.

17. The display driver of claim 13, wherein the luminance level increases over the time period associated with the sub-frame.

18. The display driver of claim 13, wherein the emission duration extension is determined in response to a refresh rate of the display being below a threshold.

* * * * *